US009862209B2

(12) United States Patent
Tanabe et al.

(10) Patent No.: US 9,862,209 B2
(45) Date of Patent: Jan. 9, 2018

(54) PRINTING APPARATUS

(71) Applicant: SEIKO EPSON CORPORATION, Tokyo (JP)

(72) Inventors: Kentaro Tanabe, Azumino (JP); Kenji Kojima, Fujimi (JP); Masaru Jingushi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/208,476

(22) Filed: Jul. 12, 2016

(65) Prior Publication Data

US 2017/0015118 A1 Jan. 19, 2017

(30) Foreign Application Priority Data

Jul. 17, 2015 (JP) ..... 2015-142717

(51) Int. Cl.

| | |
|---|---|
| ***B41J 13/00*** | (2006.01) |
| ***B41J 11/04*** | (2006.01) |
| ***B41J 3/407*** | (2006.01) |
| ***B41J 11/00*** | (2006.01) |
| ***B41J 11/42*** | (2006.01) |
| *B41J 15/04* | (2006.01) |

(52) U.S. Cl.

CPC ..... *B41J 13/0009* (2013.01); *B41J 3/4078* (2013.01); *B41J 11/007* (2013.01); *B41J 11/42* (2013.01); *B41J 15/04* (2013.01)

(58) Field of Classification Search

CPC ..... B41J 11/007; B41J 11/42; B41J 15/048
See application file for complete search history.

(56) References Cited

U.S. PATENT DOCUMENTS 6,155,669 A * 12/2000 Donahue ..... B41J 2/155 347/139
6,179,419 B1 * 1/2001 Rasmussen ..... B41J 11/007 347/104
6,599,042 B2 * 7/2003 Wolf ..... B41F 33/14 400/578

(Continued)

FOREIGN PATENT DOCUMENTS

EP 2 695 739 A2 2/2014
EP 3 121 021 A2 1/2017

(Continued)

OTHER PUBLICATIONS

European Search Report for Application No. 16178226.3 dated Feb. 17, 2017.

*Primary Examiner* — Stephen Meier
*Assistant Examiner* — John P Zimmermann
(74) *Attorney, Agent, or Firm* — Workman Nydegger

(57) ABSTRACT

A printing apparatus includes a belt mover for an endless belt which carries out a line feed of a recording medium, a feed amount calculator that calculates an amount of belt feed of the belt mover, and a movement amount measurer that measures actual amount of movement of the endless belt by image processing. The feed amount calculator calculates the amount of belt feed by which the endless belt is to be fed, on the basis of the amount of belt feed by which the endless belt has been fed and the actual amount of movement of the endless belt measured by the movement amount measurer. The belt mover moves the endless belt by the amount of belt feed calculated.

5 Claims, 7 Drawing Sheets

(56) References Cited

U.S. PATENT DOCUMENTS

| | | | | |
|---|---|---|---|---|
| 8,246,140 | B2 | 8/2012 | Maekawara et al. | |
| 8,641,165 | B2 | 2/2014 | Shimizu et al. | |
| 2002/0018097 | A1* | 2/2002 | Kitahara | B41J 2/155 347/42 |
| 2006/0165442 | A1* | 7/2006 | Kobayashi | G03G 15/1685 399/301 |
| 2007/0139459 | A1* | 6/2007 | Furuya | B41J 11/007 347/19 |
| 2008/0030536 | A1* | 2/2008 | Furukawa | B41J 11/007 347/16 |
| 2009/0322819 | A1* | 12/2009 | Hayashi | B41J 11/007 347/16 |
| 2012/0182347 | A1 | 7/2012 | Shimizu et al. | |
| 2017/0008319 | A1 | 1/2017 | Tanabe et al. | |

FOREIGN PATENT DOCUMENTS

| | | |
|---|---|---|
| JP | 5323631 | 7/2013 |
| JP | 5332884 | 8/2013 |
| JP | 2017-019624 | 1/2017 |

* cited by examiner

PRINTING APPARATUS

BACKGROUND

1. Technical Field

The present invention relates to a printing apparatus.

2. Related Art

In recent years, the textile printing of clothes of cotton, silk, wool, chemical fiber, mixed fabric, etc. employs ink jet type printing apparatuses that print patterns and the like on a cloth by discharging inks to a surface of the cloth. A printing apparatus for use in textile printing includes a belt feeder unit that mounts the cloth on an endless belt that has stickiness and thus moves the cloth, in order to use as a recording medium a cloth that has elasticity. In such printing apparatuses, errors occur in the amount of movement of the endless belt due to the eccentricity of a belt driving roller that moves the endless belt and dimensional variations in the thickness direction of the endless belt. Therefore, for example, Japanese Patent No. 5332884 discloses an ink jet recording apparatus (printing apparatus) that performs test printing to determine a corrected amount of feed according to the fed position of a transport belt (endless belt) and corrects the amount of feed of the endless belt to the corrected amount of feed. Japanese Patent No. 5332884 states that this correction makes it possible to control changes in the amount of feed related to the thickness of a joint portion of the endless belt.

When a printing apparatus equipped with an endless belt continuously performs printing on a recording medium, transport error gradually occurs due to slip between the endless belt and the belt driving roller, abrasion of the endless belt, etc. The printing apparatus described in Japanese Patent No. 5332884, while correcting the amount of feed of the endless belt by performing test printing before starting actual printing, does not have a device or the like that corrects or compensates the transport error that occurs in the continuous printing performed after the test printing.

SUMMARY

An advantage of some aspects of the invention is that printing apparatuses constructed as described below so as to solve at least part of the foregoing problem can be realized.

A printing apparatus according to one aspect of the invention includes a belt mover for an endless belt which carries out a line feed of a recording medium, a feed amount calculator that calculates an amount of belt feed of the belt mover, and a movement amount measurer that measures actual amount of movement of the endless belt by image processing. The feed amount calculator calculates the amount of belt feed by which the endless belt is to be fed, on the basis of the amount of belt feed by which the endless belt has been fed and the actual amount of movement measured by the movement amount measurer. The belt mover moves the endless belt by the amount of belt feed calculated.

Because the printing apparatus according to this aspect includes the movement amount measurer that measures the actual amount of movement of the endless belt, the printing apparatus is able to compare the amount of belt feed by which the endless belt has been fed by the belt mover and the actual amount of movement by which the endless belt has actually moved and determine an error (transport error) that has occurred in the movement of the endless belt. This transport error determined with regard to the movement of the endless belt is then reflected in the amount of belt feed by which the endless belt is subsequently to be moved, so that the transport error can be compensated or corrected in real time. Note that the term compensate in this specification and the appended claims means to completely or substantially correct or to reduce the transport error as well as to compensate the transport error. Therefore, a printing apparatus that compensates the transport error in real time so that the image quality is improved can be provided.

In the foregoing printing apparatus, the belt mover may carry out the line feed of the recording medium by a first movement in which the endless belt is moved by a first amount of feed and a second movement in which the endless belt is moved by a second amount of feed, and the second amount of feed may contain a compensation amount of feed that compensates a difference between the first amount of feed by which the endless belt has been fed and the actual amount of movement by which the endless belt has been moved by the first movement and which has been measured by the movement amount measurer.

According to this embodiment, the belt mover carries out the line feed of the recording medium by two separate movements of the endless belt which are the first movement and the second movement. The second movement includes a compensation amount of feed that compensates the error caused by the first movement, so that the accuracy of the line feed of the recording medium can be improved.

In the foregoing embodiment of the printing apparatus, the first amount of feed may be a reference amount of movement for carrying out the line feed of the recording medium by a predetermined amount of line feed, and the second amount of feed may be the compensation amount of feed.

According to this embodiment, in the first movement, the endless belt is fed by the belt mover by the first amount of feed that is the reference amount of movement for carrying out the line feed of the recording medium by a predetermined amount of line feed and, in the second movement, the endless belt is fed by the belt mover by the second amount of feed that is a compensation amount of feed that compensates the error caused by the first movement. Therefore, the error that occurs in the first movement is compensated by the second movement, so that the accuracy of the line feed of the recording medium can be improved.

In the printing apparatus according to the embodiment described above, the first amount of feed may be an amount of belt feed obtained by subtracting a predetermined value from a reference amount of movement for carrying out the line feed of the recording medium by a predetermined amount of line feed, the second amount of feed may be an amount of belt feed obtained by adding the predetermined value to the compensation amount of feed. In the second movement, the endless belt may be moved in the same direction as a moving direction in which the endless belt is moved in the first movement.

According to this embodiment, in the first movement, the endless belt is fed by the belt mover by the first amount of feed that is the amount of belt feed obtained by subtracting the predetermined value from the reference amount of movement for carrying out the line feed of the recording medium by the predetermined amount of line feed and, in the second movement, the endless belt is fed by the belt mover by the second amount of feed that is the amount of belt feed obtained by adding the predetermined value to the compensation amount of feed that compensates the error having occurred in the first movement. This predetermined value is set to such a value that the moving direction of the second movement of the endless belt is the same as the moving direction of the first movement. Therefore, the effect of the transport error that may result from moving the endless belt in opposite directions can be excluded. Hence, the accuracy of the line feed of the recording medium can be further improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
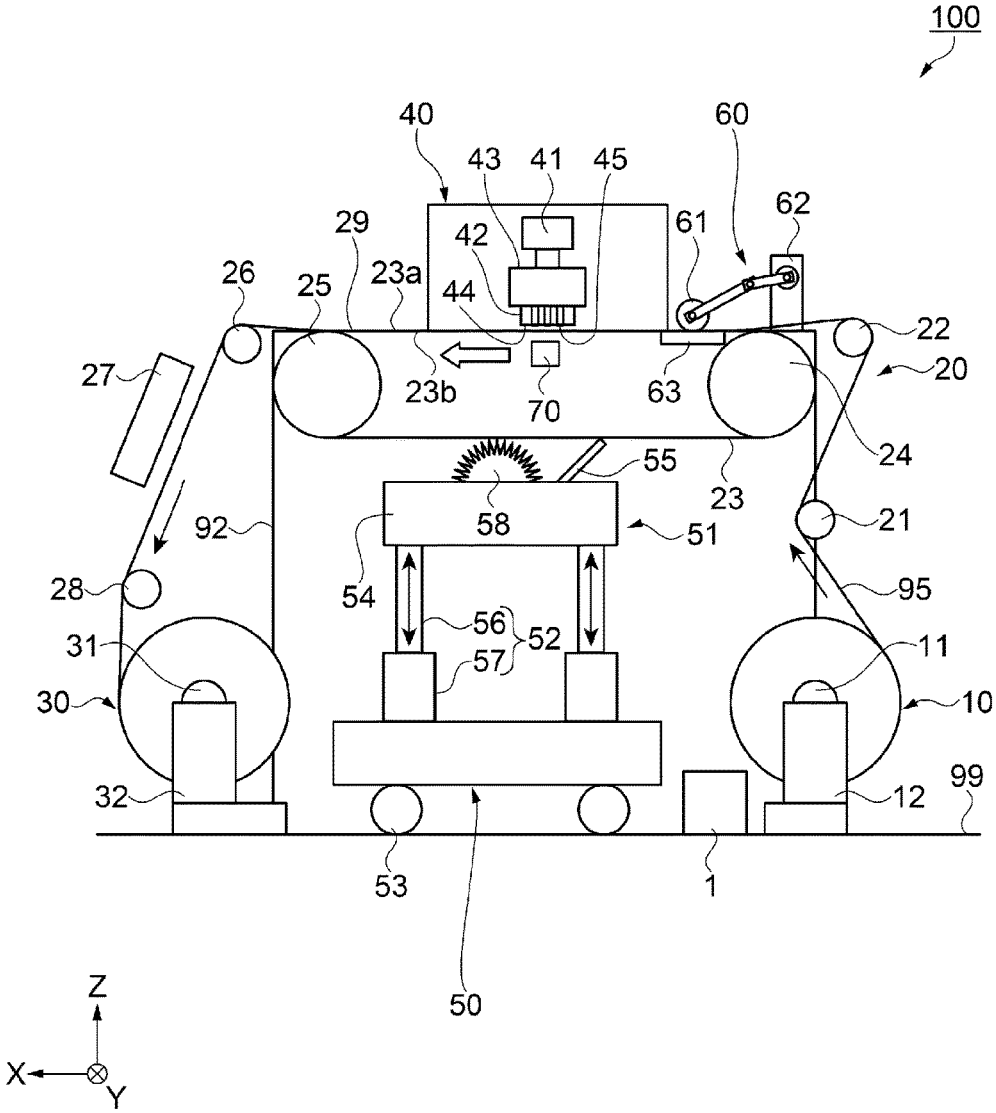
FIG. 1 is a schematic diagram showing a general overall configuration of a printing apparatus according to Exemplary Embodiment 1 of the invention.

Exemplary embodiments of the invention will be described hereinafter with reference to the accompanying drawings. In the drawings referred to below, the size proportions of individual portions and members shown are different from the actual ones so that the portions and members each have a recognizable size.

Furthermore, in FIGS. 1 to 3 and FIG. 8, for the sake of illustration, an X axis, a Y axis, and a Z axis are indicated as three mutually orthogonal axes each by an arrow whose distal end side is defined as a "plus side" and whose proximal end side is defined as a "minus side". Furthermore, in the following description, the directions parallel to the X axis are termed "X-axis directions", the directions parallel to the Y axis are termed "Y-axis directions", and the directions parallel to the Z axis are termed "Z-axis directions".

Exemplary Embodiment 1

General Configuration of Printing Apparatus

FIG. 1 is a schematic diagram illustrating a general overall configuration of a printing apparatus according to Exemplary Embodiment 1 of the invention. A printing apparatus 100 performs textile printing on a recording medium 95 by forming images and the like on a recording medium 95. As the recording medium 95, a cloth of, for example, cotton, wool, chemical fiber, mixed fabric, etc., is used. This exemplary embodiment will be described in conjunction with a configuration in which an image is formed on the band-shaped recording medium 95 in a roll method but is not limited by this configuration. For example, an image may be formed in a sheet method or the like.

As shown in FIG. 1, the printing apparatus 100 includes a recording medium supply section 10, a recording medium transport section 20, a recording medium collection section 30, a printing section 40, a washing unit 50, and a medium close-contact section 60. The printing apparatus 100 also includes a control section 1 that controls these sections and the like. These sections and the like of the printing apparatus 100 are attached to a frame portion 92.

The recording medium supply section 10 supplies the recording medium 95 on which an image is formed, to a printing section 40 side. The recording medium supply section 10 includes a supply shaft portion 11 and a bearing portion 12. The supply shaft portion 11 has a hollow cylindrical shape or a solid cylindrical shape and is provided rotatably in circumferential directions. The band-shaped recording medium 95 has been wound in a roll shape around the supply shaft portion 11. The supply shaft portion 11 is detachably attached to the bearing portion 12. Therefore, the recording medium 95 wound on the supply shaft portion 11 beforehand can be attached together with the supply shaft portion 11 to the bearing portion 12.

The bearing portion 12 supports two ends of the supply shaft portion 11 in its axis direction so that the supply shaft portion 11 is rotatable. The recording medium supply section 10 includes a rotation driving portion (not graphically shown) that rotationally drives the supply shaft portion 11. The rotation driving portion rotates the supply shaft portion 11 in a direction in which the recording medium 95 is fed. Operations of the rotation driving portion are controlled by the control section 1.

The recording medium transport section 20 transports the recording medium 95 from the recording medium supply section 10 to the recording medium collection section 30. The recording medium transport section 20 includes a transport roller 21, another transport roller 22, an endless belt 23, a belt turning roller 24, a belt driving roller 25, still another transport roller 26, a dryer unit 27, and yet another transport roller 28. The transport rollers 21 and 22 relay the recording medium 95 from the recording medium supply section 10 to the endless belt 23.

The endless belt 23 has been formed to be endless by connecting two opposite ends of a band-shaped belt. The endless belt 23 has been wrapped around the belt turning roller 24 and the belt driving roller 25. The endless belt 23 is held with a predetermined tension acting so that portions of the endless belt 23 between the belt turning roller 24 and the belt driving roller 25 are parallel to a floor surface 99. A sticky layer 29 to which the recording medium 95 is caused to adhere is provided on a surface (support surface) 23*a* of the endless belt 23. The endless belt 23 supports (holds) the recording medium 95 that is supplied from the transport roller 22 and that is stuck closely to the sticky layer 29 by the medium close-contact section 60 described later. Therefore, a cloth having elasticity and the like can be handled as a recording medium 95.

The belt turning roller 24 and the belt driving roller 25 support an inner peripheral surface 23*b* of the endless belt 23. A support portion for supporting the endless belt 23 may be provided between the belt turning roller 24 and the belt driving roller 25.

The belt driving roller 25 is a belt mover for the endless belt 23 which performs the line feeding of the recording medium 95. When the belt driving roller 25, as the belt mover, is driven, the rotation of the belt driving roller 25 turns the endless belt 23 and, in turn, the rotation of the endless belt 23 turns the belt turning roller 24. Due to the rotation of the endless belt 23, the recording medium 95 supported by the endless belt 23 is transported in the predetermined transport direction so that a line feed is completed. The line feed of the recording medium 95 and the discharge of inks from the printing section 40 are repeatedly performed to form an image on the recording medium 95. In this exemplary embodiment, the recording medium 95 is supported on a side (plus Z side) where a surface 23*a* of the endless belt 23 faces the printing section 40, and the recording medium 95 is transported together with the endless belt 23 from the belt turning roller 24 side to the belt driving roller 25 side. Furthermore, at the side (minus Z side) where the surface 23*a* of the endless belt 23 faces the washing unit 50, the endless belt 23 alone moves from the belt driving roller 25 side to the belt turning roller 24 side.

Incidentally, the "line feed" herein means to transport the recording medium 95 (i.e., the endless belt 23 supporting the recording medium 95) in order to discharge ink droplets for the next line on the recording medium 95 after discharging ink droplets while scanning (moving) a discharge head 42 described later for a line in a width direction of the recording medium 95. Besides, the "line feed" includes transporting the recording medium 95 in the transport direction after discharging ink droplets from a line-type discharge head, without scanning the head in the width direction of the recording medium 95.

The transport roller 26 separates the recording medium 95 having a formed image, from the sticky layer 29 of the endless belt 23. The transport rollers 26 and 28 relay the recording medium 95 from the endless belt 23 to the recording medium collection section 30.

The recording medium collection section 30 collects the recording medium 95 transported by the recording medium transport section 20. The recording medium collection section 30 includes a take-up shaft portion 31 and a bearing portion 32. The take-up shaft portion 31 has a hollow or solid cylindrical shape and is provided rotatably in the circumferential directions. The band-shaped recording medium 95 has been wound in a roll shape on the take-up shaft portion 31. The take-up shaft portion 31 is detachably attached to the bearing portion 32. Therefore, the recording medium 95 wound on the take-up shaft portion 31 can be detached together with the take-up shaft portion 31.

The bearing portion 32 supports two end portions of the take-up shaft portion 31 in its axis direction so that the take-up shaft portion 31 is rotatable. The recording medium collection section 30 includes a rotation driving portion (not graphically shown) that rotationally drives the take-up shaft portion 31. The rotation driving portion rotates the take-up shaft portion 31 in such a direction that the recording medium 95 is wound around the take-up shaft portion 31. Operations of the rotation driving portion are controlled by the control section 1.

In this exemplary embodiment, the dryer unit 27 is dispose between the transport roller 26 and the transport roller 28. The dryer unit 27 dries the image formed on the recording medium 95. The dryer unit 27 includes, for example, an IR (infrared) heater, and is capable of quickly drying the image formed on the recording medium 95 by activating the IR heater. Therefore, the band-shaped recording medium 95 with an image formed thereon can be wound around the take-up shaft portion 31.

The medium close-contact section 60 brings the recording medium 95 into close contact with the endless belt 23. The medium close-contact section 60 is disposed at an upstream side (the minus X side) of the printing section 40 in the transport direction of the recording medium 95. The medium close-contact section 60 includes a pressing roller 61, a pressing roller driving portion 62, and a roller support portion 63. The pressing roller 61 has a hollow or solid cylindrical shape and is provided rotatably in its circumferential directions. In order to cause the pressing roller 61 to be rotatable in directions along the transport direction, the pressing roller 61 is disposed so that the axis direction of the pressing roller 61 intersects with the transport direction. The roller support portion 63 is provided at the inner peripheral surface 23*b* side of the endless belt 23 so as to face the pressing roller 61 across the endless belt 23.

The pressing roller driving portion 62 moves the pressing roller 61 in the transport direction (plus X-axis direction) and in the direction opposite to the transport direction (which is the minus X-axis direction) while pressing the pressing roller 61 to a downward side in the vertical directions (to the minus Z side). After the recording medium 95 transported from the transport roller 22 is superposed on the endless belt 23, the recording medium 95 is pressed against the endless belt 23 between the pressing roller 61 and the roller support portion 63. Therefore, the recording medium 95 can be certainly stuck to the sticky layer 29 provided on the surface 23*a* of the endless belt 23, so that the recording medium 95 on the endless belt 23 is prevented from lifting off of the surface 23*a*.

The printing section 40 includes an ink jet type discharge head 42 that discharges inks in the form of liquid droplets to the recording medium 95 and a carriage mover 41 that moves the carriage 43 on which the discharge head 42 has been mounted. The printing section 40 is disposed above (at the plus Z side of) the position at which the endless belt 23 has been disposed. The discharge head 42 has a discharge surface 44 in which a plurality of nozzle arrays 45 have been formed. For example, the discharge surface 44 has four nozzle arrays 45 that have been formed so that each of the nozzle arrays 45 discharges an ink whose color (e.g., cyan (C), magenta (M), yellow (Y), or black (K)) is different from those of the inks that the other nozzle arrays 45 discharge. The discharge surface 44 faces the recording medium 95 that is transported by the endless belt 23.

The carriage mover 41 moves the discharge head 42 in directions that intersect with the transport direction of the recording medium 95 (the width directions of the recording medium 95 (Y-axis directions)). The carriage 43 is supported by guide rails (not graphically shown) that are disposed along the Y-axis directions and is movable back and forth in the plus and minus Y-axis directions by the carriage mover 41. The carriage mover 41 employed herein may be, for example, a mechanism that combines a ball screw and a ball nut, a linear guide mechanism, etc.

Furthermore, the carriage mover 41 is provided with a motor (not graphically shown) as a power source for moving the carriage 43 along the Y-axis directions. As the motor is driven, controlled by the control section 1, the discharge head 42 is moved back and forth in the Y-axis directions, together with the carriage 43. Although in the exemplary embodiment, the discharge head 42 is of a serial head type that is mounted on the movable carriage and discharges ink while moving in the width directions of the recording medium 95 (plus and minus Y-axis directions), the discharge head 42 may be of the line head type that is stationarily disposed and extends in the width directions of the recording medium 95 (Y-axis directions).

The printing apparatus 100 includes the washing unit 50 for washing the endless belt 23. More specifically, the washing unit 50 is made up of a washing portion 51, a pressing portion 52, and a movement portion 53. The movement portion 53 is capable of moving the washing unit 50 as an integral unit along the floor surface 99 and fixing the washing unit 50 at a predetermined position. The washing unit 50 is disposed between the belt turning roller 24 and the belt driving roller 25 in the X-axis directions.

The pressing portion 52 is, for example, an elevator apparatus made up of air cylinders 56 and ball bushes 57, and causes the washing portion 51 provided on top of the pressing portion 52 to be movable between a washing position and a withdrawn position. The washing position is a position at which a washing roller 58 and a blade 55 come into contact with the endless belt 23. The withdrawn position is a position at which the washing roller 58 and the blade 55 are apart from the endless belt 23. The washing portion 51, when at the washing position, washes, from below (from the minus Z-axis direction), the surface (support surface) 23*a* of the endless belt 23 wrapped around the belt turning roller 24 and the belt driving roller 25 with a predetermined tension acting. FIG. 1 shows a case where the washing portion 51 has been raised to the washing position.

The washing portion 51 includes a washing tank 54, the washing roller 58, and the blade 55. The washing tank 54 is a tank that holds a washing liquid to be used to wash ink or undesired matters from the surface 23*a* of the endless belt 23. The washing roller 58 and the blade 55 are provided inside the washing tank 54. The washing liquid for use herein may be water or a water-soluble solvent (alcohol aqueous solution or the like) and may also contain a surface-active agent or an antifoaming agent according to need.

A lower-side (minus Z-side) portion of the washing roller 58 is submerged in the washing liquid held in the washing tank 54. When the washing roller 58 rotates at the washing position, the washing liquid is supplied to the surface 23*a* of the endless belt 23 and, at the same time, the washing roller 58 and the endless belt 23 slide against each other. Therefore, ink, fiber of the cloth as the recording medium 95, and the like which have been deposited on the endless belt 23 are removed by the washing roller 58.

The blade 55 may be formed from a flexible material, for example, silicon rubber or the like. The blade 55 is provided at a downstream side of the washing roller 58 in the transport direction of the endless belt 23. As the endless belt 23 and the blade 55 slide against each other, the washing liquid remaining on the surface 23*a* of the endless belt 23 is removed.

Figure 2:
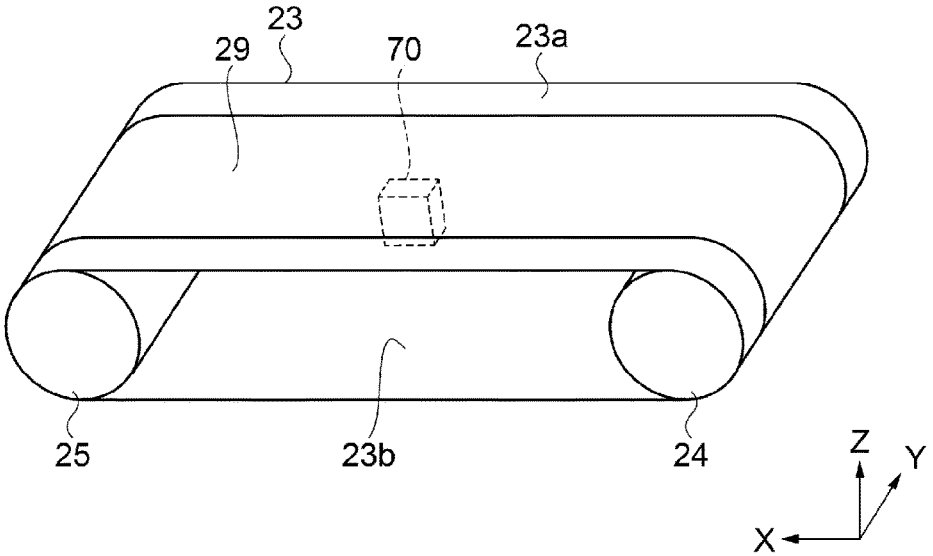
FIG. 2 is an enlarged perspective view of an endless belt.
Figure 3:
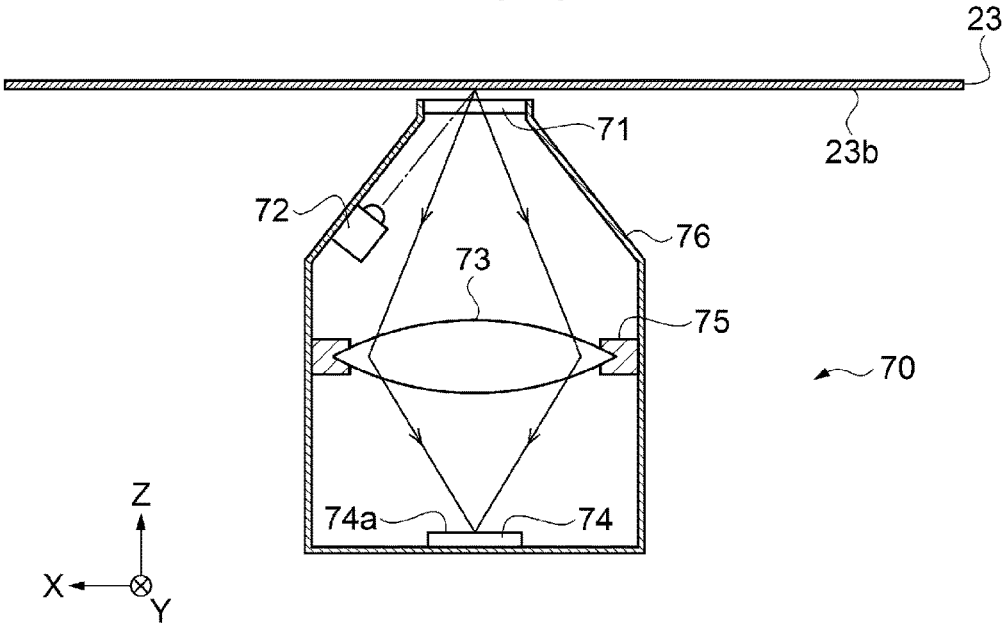
FIG. 3 is a sectional view of a movement amount detection sensor as a movement amount measurer.

FIG. 2 is an enlarged perspective view of the endless belt 23. FIG. 3 is a sectional view of a movement amount detection sensor as a movement amount measurer. Using FIGS. 2 and 3, a movement amount detection sensor 70 provided to determine the amount of movement of the endless belt 23 will be described.

The movement amount detection sensor 70 is a movement amount measurer that measures the actual amount of movement of the endless belt 23 by image processing. The movement amount detection sensor 70 provided as a movement amount measurer is a sensor for taking images for use for determining the actual amount of movement made by the endless belt 23 by comparing the positions of the endless belt 23 before and after the movement of the endless belt 23. As shown in FIGS. 2 and 3, the movement amount detection sensor 70 is disposed at a position that faces the printing section 40 (see FIG. 1) across the endless belt 23 so as to take images of the inner peripheral surface 23*b* of the endless belt 23.

Although this exemplary embodiment has a configuration in which the movement amount detection sensor 70 is provided facing the inner peripheral surface 23*b* of the endless belt 23, this configuration is not restrictive. The movement amount detection sensor 70 may be provided at such a position as to be able to take images of a portion of the surface 23*a* of the endless belt 23 which is not provided with the sticky layer 29 or the surface of the recording medium 95 (see FIG. 1) mounted on the endless belt 23. It is preferable that the movement amount detection sensor 70 be provided in the vicinity of the printing section 40. Furthermore, in the case where images of the surface 23*a* or the inner peripheral surface 23*b* of the endless belt 23 are to be taken, it is preferable that the surface whose images are to be taken have protuberances and depressions. This allows clear images of the surface to be taken, so that the accuracy of calculation of the amount of movement of the endless belt 23 improves.

As shown in FIG. 3, the movement amount detection sensor 70 has a light emitting portion 72, a condenser lens 73, an image pickup element 74, etc. inside a case 76.

The case 76 forms an exterior of the movement amount detection sensor 70. The case 76 has a shape that combines a truncated cone and a cylinder. A translucent glass pane 71 has been attached to a distal end portion (upper end portion) of the case 76. The translucent glass pane 71 faces the inner peripheral surface 23*b* of the endless belt 23 in the vertical directions with an intervening space.

The light emitting portion 72 emits light toward the endless belt 23. The light emitting portion 72 is provided on an inner wall surface of the case 76 in such an angle posture as to be able to emit light toward the translucent glass pane 71. The light emitting portion 72 may be, for example, a light emitting diode (LED) or the like.

The condenser lens 73 condenses reflected light that is incident within the case 76 after being emitted from the light emitting portion 72, passing through the translucent glass pane 71, reflecting from the inner peripheral surface 23*b* of the endless belt 23, and then passing through the translucent glass pane 71 again. The condenser lens 73 is provided within a cylindrical portion of the case 76.

The image pickup element 74 takes images of the inner peripheral surface 23*b* of the endless belt 23 produced by light condensed by the condenser lens 73. An image pickup surface 74*a* is provided at a position at which images are formed. The image pickup element 74 is provided on an internal bottom surface of the case 76. Incidentally, the condenser lens 73 is held by a holder member 75 at a height such that an image of the inner peripheral surface 23*b* of the endless belt 23 is formed on the image pickup surface 74*a* of the image pickup element 74.

The movement amount detection sensor 70 outputs image data acquired by the image pickup element 74 to the control section 1. The control section 1 compares the image data obtained before and after a movement of the endless belt 23 and calculates the actual amount of movement by which the endless belt 23 has been actually moved.

Electrical Configuration of Printing Apparatus

Figure 4:
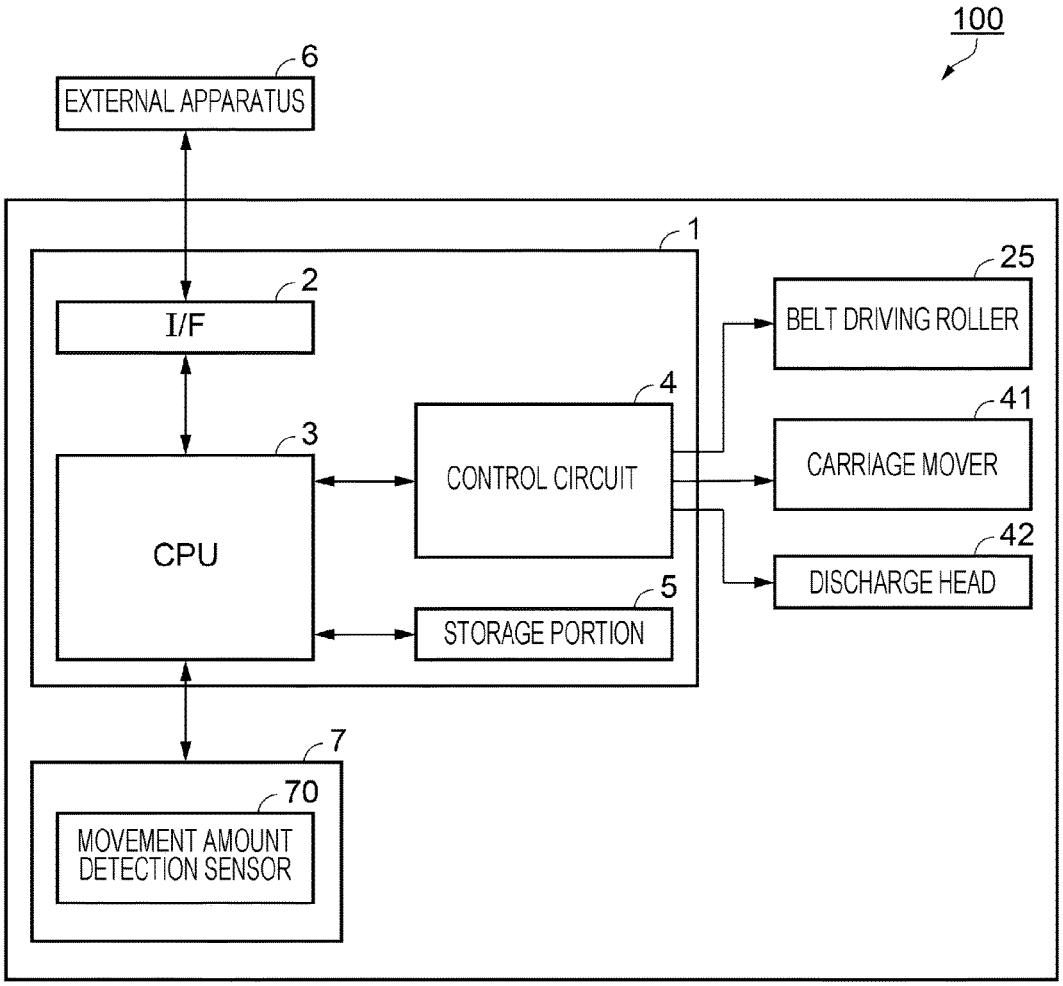
FIG. 4 is an electrical block diagram illustrating an electrical configuration of a printing apparatus.

FIG. 4 is an electrical block diagram illustrating an electrical configuration of a printing apparatus. An electrical configuration of the printing apparatus 100 will be described with reference to FIG. 4.

The control section 1 is a control unit for controlling the printing apparatus 100. The control section 1 includes a control circuit 4, an interface portion (I/F) 2, a CPU (central processing unit) 3, and a storage portion 5. The interface portion 2 is used to send and receive data between the printing apparatus 100 and an external apparatus 6 that handles images, such as a computer or a digital camera. The CPU 3 is a computation apparatus for performing the processing of signals input from a detector group 7 and overall control of the printing apparatus 100. The detector group 7 includes the movement amount detection sensor 70 as a movement amount measurer for the endless belt 23.

The storage portion 5 secures a region for storing programs of the CPU 3 and a working region for the CPU 3 and includes storage elements such as a RAM (random access memory) and an EEPROM (electrically erasable programmable read-only memory).

The CPU 3, using the control circuit 4, controls the belt driving roller 25 that moves the endless belt 23 in the transport direction, the carriage mover 41 that moves the carriage 43 on which the discharge head 42 has been mounted in directions that intersect with the transport direction, the discharge head 42 that discharges inks to the recording medium 95, and other various devices (not graphically shown).

Printing Operation of Printing Apparatus

Figure 5:
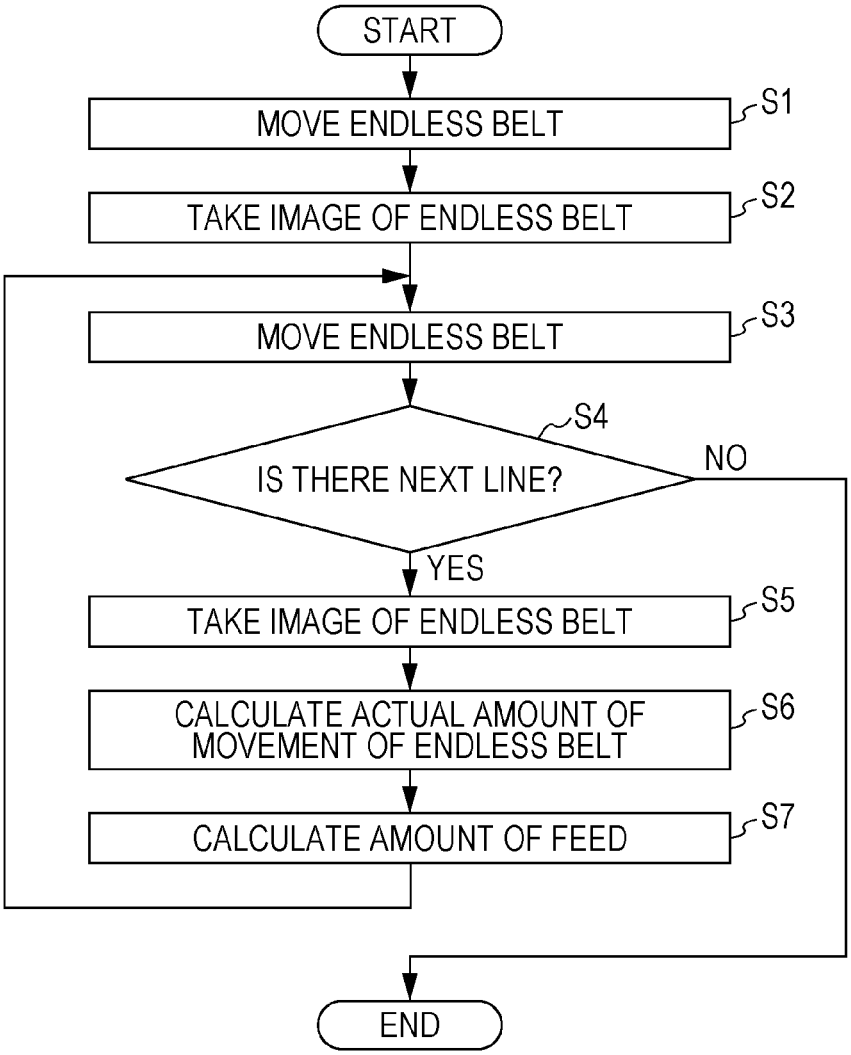
FIG. 5 is a flowchart illustrating a printing operation of the printing apparatus.

FIG. 5 is a flowchart illustrating a printing operation of a printing apparatus. Using FIG. 4 and FIG. 5, a printing operation of the printing apparatus 100 will be described.

In step S1, the printing apparatus 100 moves the endless belt 23. The control section 1 controls the belt driving roller 25 to move the endless belt 23 so that the recording medium 95 is transported to a predetermined position.

In step S2, an image of the endless belt 23 is taken. The control section 1 controls the movement amount detection sensor 70 as a movement amount measurer so as to take an image of the inner peripheral surface 23*b* of the endless belt 23 prior to a movement of the endless belt 23 for a line feed of the recording medium 95, and then stores the acquired image data into the storage portion 5.

In step S3, the endless belt 23 is moved. The control section 1 moves the endless belt 23 by using the belt driving roller 25 as the belt mover. The control section 1 drives the belt driving roller 25 to feed the endless belt 23 by an amount of belt feed which has been stored in the storage portion 5. Due to this operation, the recording medium 95 mounted on the endless belt 23 is fed in the transport direction for the next line. The storage portion 5 stores as an amount of belt feed a value obtained by adding a compensation amount of feed determined at the time of the immediately previous line feed (see step S7) to a reference amount of movement for carrying out a line feed of the recording medium 95 by a predetermined amount of line feed. Incidentally, at the time of the initial line feed, the control section 1 moves the endless belt 23 by the reference amount of movement.

After moving the endless belt 23, the control section 1 controls the carriage mover 41 and the discharge head 42 so that the printing for the new line set by the line feed is performed by discharging inks from the discharge head 42 to the recording medium 95 while moving the carriage 43 in a direction that intersects with the transport direction of the recording medium 95.

In step S4, it is determined whether there is a next line feed. The CPU 3 determines whether there is line feed data for the recording medium 95 by referring to print data stored in the storage portion 5. If there is a next line feed (YES in step S4), the printing operation of the printing apparatus 100 proceeds to step S5. If there is not a next line feed (NO in step S4), the control section 1 ends the printing operation of the printing apparatus 100. Incidentally, in the case where the band-shaped recording medium 95 is continuously subjected to textile printing, the control section 1 starts the printing operation of the printing apparatus 100 in step S1 again.

In step S5, an image of the endless belt 23 is taken. The CPU 3 controls the movement amount detection sensor 70 as the movement amount measurer so as to take an image of the inner peripheral surface 23*b* of the endless belt 23 after the movement of the endless belt 23 for the line feed of the recording medium 95, and then stores the acquired image data in the storage portion 5.

In the step S6, the actual amount of movement of the endless belt 23 is calculated. The CPU 3 calculates the actual amount of movement of the endless belt 23 on the basis of the image data acquired by the movement amount detection sensor 70. Specifically, the calculates the actual amount of movement by which the endless belt 23 has actually moved, by referring to and comparing the image data of the endless belt 23 acquired and stored in the storage portion 5 prior to the movement of the endless belt 23 and the post-movement image data of the endless belt 23 acquired and stored in the storage portion 5 in step S5. Incidentally, at the time of the initial line feed, the CPU 3 refers to the image data acquired in step S2 as image data obtained prior to the movement of the endless belt 23. Furthermore, at the times of the second and later line feeds, the CPU 3 refers to the image data acquired in step S5 at the time of the previous line feed as the image data obtained prior to the movement of the endless belt 23.

In step S7, the amount of belt feed of the belt driving roller 25 is calculated. The CPU 3 calculates the amount of belt feed by which to feed the endless belt 23 on the basis of the amount of belt feed by which the endless belt 23 has been fed and the actual amount of movement of the endless belt 23 measured by the movement amount detection sensor 70 as the movement amount measurer. Specifically, the CPU 3 calculates as a compensation amount of feed a difference between the amount of belt feed by which the endless belt 23 was fed by the belt driving roller 25 at the time of line feed of the recording medium 95 in step S3 and the actual amount of movement of the endless belt 23 calculated in step S6. Then, the CPU 3 stores the value obtained by adding the compensation amount of feed to the reference amount of movement as the amount of belt feed of the endless belt 23 at the time of the next line feed. Therefore, the transport error of the endless belt 23 caused by a line feed of the recording medium 95 can be compensated at the time of the next line feed of the recording medium 95. Incidentally, the operation of the CPU 3 in step S7 corresponds to a feed amount calculator that calculates the amount of feed by the belt driving roller 25 as a belt mover.

As described above, the printing apparatus 100 according to this exemplary embodiment can achieve the following advantageous effects.

The printing apparatus 100 includes the movement amount detection sensor 70 that takes images of the inner peripheral surface 23*b* of the endless belt 23 as a movement amount measurer. The control section 1 is able to measure the actual amount of movement of the endless belt 23 by comparing the image data acquired by the movement amount detection sensor 70 before and after the movement of the endless belt 23. The CPU 3 calculates as a compensation amount of feed the transport error determined from the amount of belt feed by which the endless belt 23 is fed by the belt driving roller 25 at the time of a line feed of the recording medium 95 and the actual amount of movement of the endless belt 23 and then reflects the calculated correction amount of feed in the amount of belt feed at the time of the next line feed of the recording medium 95. Thus, the transport error caused by continuous use of the printing apparatus 100 can be compensated in real time. Therefore, the printing apparatus 100 that compensates the transport error in real time so as to improve image quality can be provided.

Exemplary Embodiment 2

Figure 6:
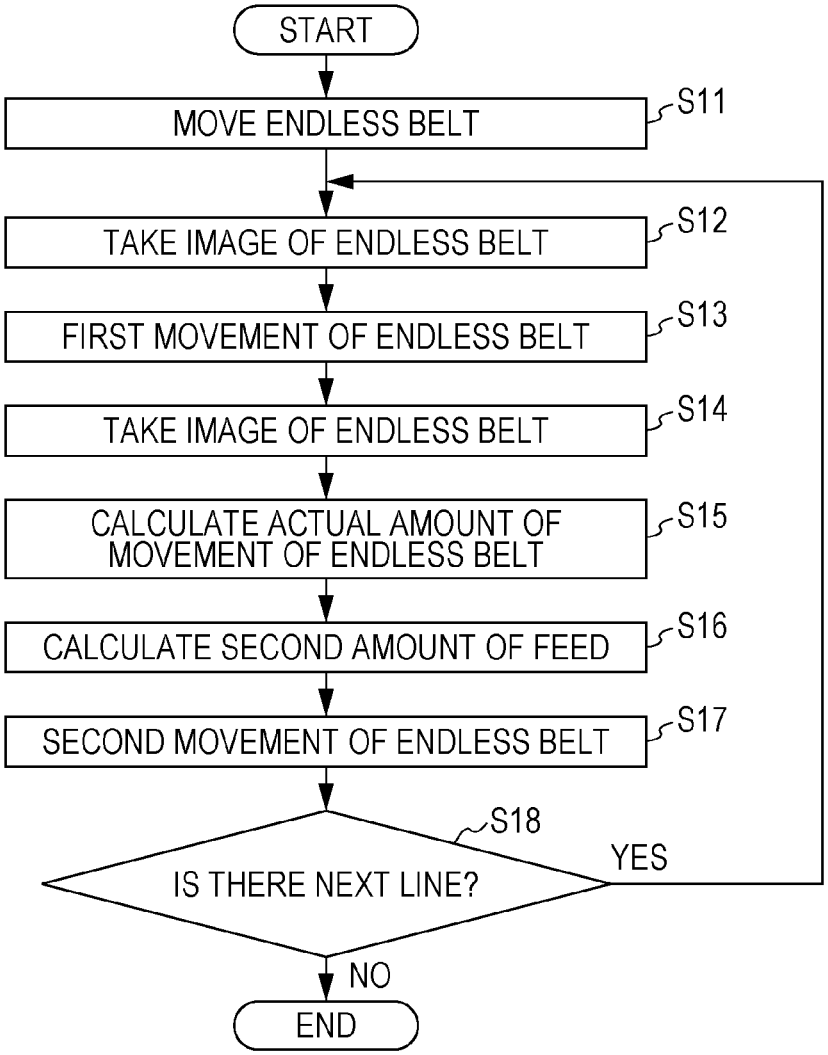
FIG. 6 is a flowchart illustrating a printing operation of a printing apparatus according to Exemplary Embodiment 2.

FIG. 6 is a flowchart illustrating a printing operation of a printing apparatus according to Exemplary Embodiment 2. With reference to FIGS. 4 to 6, a printing operation of a printing apparatus 100 will be described. Note that in Exemplary Embodiment 2, the line feed of the recording medium 95 is carried out by two movements, that is, a first movement in which the endless belt 23 is moved by a first amount of feed and a second movement in which the endless belt 23 is moved by a second amount of feed.

In step S11, the printing apparatus 100 moves the endless belt 23. The control section 1 controls the belt driving roller 25 to move the endless belt 23 so that the recording medium 95 is transported to a predetermined print start position.

After moving the endless belt 23, the control section 1 controls the carriage mover 41 and the discharge head 42 so that the carriage 43 is moved in a direction that intersects with the transport direction of the recording medium 95 and, simultaneously, ink is discharged from the discharge head 42 to the recording medium 95. Thus, printing of the initial line is performed.

In step S12, an image of the endless belt 23 is taken. The control section 1 controls the movement amount detection sensor 70 as a movement amount measurer so as to take an image of the inner peripheral surface 23*b* of the endless belt 23 prior to the first movement that carries out the line feed of the recording medium 95. The control section 1 stores the thus-acquired image data in the storage portion 5.

In step S13, the first movement of the endless belt 23 is carried out. The control section 1 executes the first movement in which the endless belt 23 is moved by the first amount of feed by the belt driving roller 25 as a belt mover. The control section 1 drivers the belt driving roller 25 so that the endless belt 23 is fed by the first amount of feed stored in the storage portion 5. The storage portion 5 stores as the first amount of feed a reference amount of movement for carrying out a line feed of the recording medium 95 by a predetermined amount of line feed.

In step S14, an image of the endless belt 23 is taken. The CPU 3 controls the movement amount detection sensor 70 so as to take an image of the inner peripheral surface 23*b* of the endless belt 23 after the first movement of the endless belt 23, and stores the acquired image data in the storage portion 5.

In step S15, the actual amount of movement of the endless belt 23 is calculated. The CPU 3 calculates the actual amount of movement of the endless belt 23 achieve by the first movement on the basis of the image data acquired by the movement amount detection sensor 70 as the movement amount measurer. Specifically, the CPU 3 calculates the actual amount of movement of the endless belt 23 achieved by the first movement by referring to and comparing the pre-first movement acquired image data of the endless belt 23 acquired and stored in the storage portion 5 in step S12 and the post-first movement acquired image data of the endless belt 23 acquired and stored in the storage portion 5 in step S14.

In step S16, a second amount of feed is calculated. The CPU 3 calculates a compensation amount of feed that compensates a difference (transport error) between the first amount of feed by which the endless belt 23 was fed by the belt driving roller 25 in step S13 and the actual amount of movement of the endless belt 23 achieved by the first movement calculated in step S15. Then, the CPU 3 stores this compensation amount of feed in the storage portion 5 as a second amount of feed to be made at the time of the second movement of the endless belt 23. Note that the operation of the CPU 3 in step S16 corresponds to the feed amount calculator that calculates the amount of feed (second amount of feed) made by the belt driving roller 25 as the belt mover.

In step S17, the second movement of the endless belt 23 is performed. The control section 1 executes the second movement in which the endless belt 23 is moved by the second amount of feed by the belt driving roller 25 provided as the belt mover. The control section 1 drives the belt driving roller 25 to feed the endless belt 23 by the second amount of feed stored in the storage portion 5. Because the second movement in which the endless belt 23 is moved by the second amount of feed (compensation amount of feed) compensates the transport error that occurred in the first movement, the accuracy of the line feed of the recording medium 95 can be further improved.

After the second movement of the endless belt 23, the control section 1 controls the carriage mover 41 and the discharge head 42 so as to carry out the printing for the new line set by the line feed by ejecting inks from the discharge head 42 to the recording medium 95 while moving the carriage 43 in a direction that intersects with the transport direction of the recording medium 95.

In step S18, it is determined whether there is a next line feed. The CPU 3 determines whether there is a next line feed of the recording medium 95 by referring to the print data stored in the storage portion 5. If there is a next line feed (YES in step S18), the printing operation of the printing apparatus 100 goes back to step S12 and the process of steps S12 to S18 is repeated. If there is not a next line feed (NO in step S18), the control section 1 ends the printing operation of the printing apparatus 100. Note that in the case where the textile printing is to be continuously performed on the band-shaped recording medium 95, the control section 1 restarts the printing operation of the printing apparatus 100 in step S11.

As stated above, the printing apparatus 100 of this exemplary embodiment can achieve the following advantageous effects.

The printing apparatus 100 carries out the line feed of the recording medium 95 by two movements of the endless belt 23 that are the first movement and the second movement by driving the belt driving roller 25 as the belt mover. In the first movement, the endless belt 23 is moved by the first amount of feed that is the reference amount of movement for carrying out a line feed of the recording medium 95 by a predetermined amount of line feed. In the second movement, the endless belt 23 is moved by the second amount of feed (compensation amount of feed) that is the difference (transport error) between the first amount of feed by which the endless belt 23 is fed in the first movement and the actual amount of movement of the endless belt 23 achieved in the first movement. Therefore, the transport error having occurred in the first movement is compensated by the second movement, so that the accuracy of the line feed of the recording medium 95 and the quality of images recorded on the recording medium 95 improve.

Exemplary Embodiment 3

Figure 7:
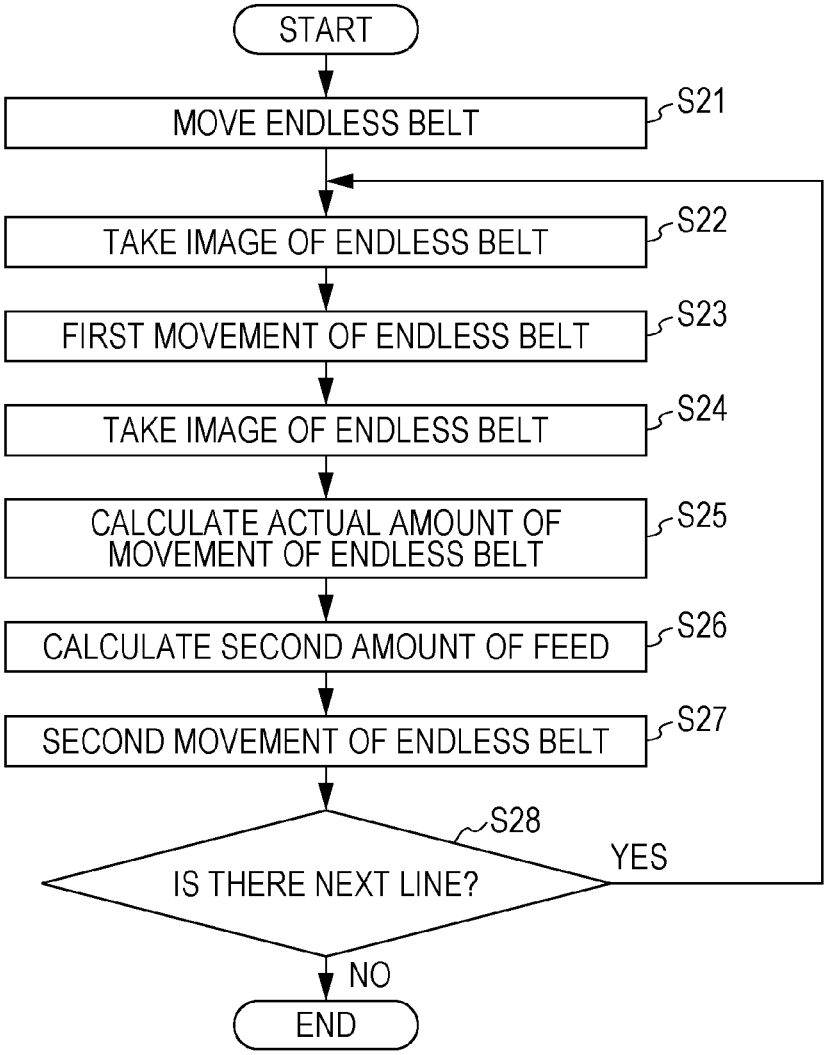
FIG. 7 is a flowchart illustrating a printing operation of a printing apparatus according to Exemplary Embodiment 3.

FIG. 7 is a flowchart illustrating a printing operation of a printing apparatus according to Exemplary Embodiment 3. With reference to FIG. 4 and FIG. 7, a printing operation of the printing apparatus 100 will be described. Note that, in Exemplary Embodiment 3, the first amount of feed and the second amount of feed are different from those in Exemplary Embodiment 2. Furthermore, in the flowchart shown in FIG.

7, steps S21, S22, and S24 are the same processes as steps S11, S12, and S14 in the flowchart shown in FIG. 6 in conjunction with Exemplary Embodiment 2. Description of these steps will be omitted below.

In step S23, the first movement of the endless belt 23 is carried out. The control section 1 executes the first movement in which the endless belt 23 is moved by the first amount of feed by the belt driving roller 25 as a belt mover. The control section 1 drives the belt driving roller 25 so as to feed the endless belt 23 by the first amount of feed stored in the storage portion 5. The storage portion 5 stores, as the first amount of feed, an amount of belt feed obtained by subtracting a predetermined value from a reference amount of movement for carrying out a line feed of the recording medium 95 by a predetermined amount of line feed.

In step S25, the actual amount of movement of the endless belt 23 is calculated. The CPU 3 calculates the actual amount of movement of the endless belt 23 achieved by the first movement on the basis of the image data acquired by the movement amount detection sensor 70 as a movement amount measurer. Specifically, the CPU 3 calculates the actual amount of movement of the endless belt 23 actually achieved by the first movement by referring to and comparing the image data prior to the first movement of the endless belt 23 which was acquired and stored in the storage portion 5 in step S22 and the image data subsequent to the first movement of the endless belt 23 which was acquired and stored in the storage portion 5 in step S24.

In step S26, the second amount of feed is calculated. The CPU 3 calculates a compensation amount of feed that compensates a difference (transport error) between the first amount of feed by which the endless belt 23 was fed by the belt driving roller 25 in step S23 and the actual amount of movement of the endless belt 23 achieved by the first movement which was calculated in step S25. The CPU 3 stores an amount of belt feed obtained by adding a predetermined value to the foregoing compensation amount of feed in the storage portion 5 as the second amount of feed at the time of the second movement. Note that the operation of the CPU 3 in step S26 corresponds to a feed amount calculator that calculates the amount of feed (second amount of feed) caused by the belt driving roller 25 as the belt mover.

In step S27, the second movement of the endless belt 23 is carried out. The control section 1 executes the second movement in which the endless belt 23 is moved by the second amount of feed by the belt driving roller 25 as the belt mover. The control section 1 drives the belt driving roller 25 so as to feed the endless belt 23 by the second amount of feed stored in the storage portion 5. In this second movement, the endless belt 23 is moved in the same direction as the moving direction of the first movement. More specifically, the predetermined value that is subtracted in determining the first amount of feed and that is added in determining the second amount of feed is the absolute value of a maximum transport error assumable when the endless belt 23 is moved by the reference amount of movement and is set at a value such that, at the time of the second movement, the endless belt 23 is not moved in the direction opposite to the direction of the first movement. Therefore, for the second movement, the belt driving roller 25 that moves the endless belt 23 is rotated in the same direction as for the first movement. If the rotation directions of the belt driving roller 25 are different, the amounts of transport of the endless belt 23 are also different, so that a transport error may occur. Such a transport error is excluded in this embodiment since the rotation direction of the belt driving roller 25 is the same between the first movement and the second movement.

In step S28, it is determined whether there is a next line feed. The CPU 3 determines whether there is line feed data of the recording medium 95 by referring to the print data stored in the storage portion 5. If there is a next line feed (YES in step S28), the printing operation of the printing apparatus 100 goes back to step S22 and the process of steps S22 to S28 is repeated. If there is not a next line feed (NO in step S28), the control section 1 ends the printing operation of the printing apparatus 100. Note that in the case where the textile printing is continuously performed on the band-shaped recording medium 95, the control section 1 restarts the printing operation of the printing apparatus 100 in step S21.

Note that the printing apparatus 100 may have a plurality of print modes that include the printing operations illustrated above in conjunction with Exemplary Embodiments 1 to 3 and may be able to select any one of the print modes.

The printing apparatus 100 according to the foregoing exemplary embodiment can achieve the following advantageous effects in addition to the advantageous effects of Exemplary Embodiment 2.

The printing apparatus 100 drives the belt driving roller 25 as a belt mover so as to carry out the line feed of the recording medium 95 by two movements of the endless belt 23 that are the first movement and the second movement. In the first movement, the endless belt 23 is moved by the first amount of feed that is the amount of belt feed obtained by subtracting a predetermined value from the reference amount of movement for carrying out a line feed of the recording medium 95 by a predetermined amount of line feed. In the second movement, the endless belt 23 is moved by the second amount of feed (compensation amount of feed) that is the amount of belt feed obtained by adding the predetermined value to the transport error that occurs at the time of the first movement. Since the predetermined value is the absolute value of the maximum transport error assumable when the endless belt 23 is moved by the reference amount of movement, the first movement and the second movement have the same moving direction of the endless belt 23 and therefore the same rotation direction of the belt driving roller 25 that moves the endless belt 23. Therefore, it is possible to exclude the effects of the transport error that can occur because the rotation direction of the belt driving roller 25 is different between the first movement and the second movement.

Modifications

Figure 8:
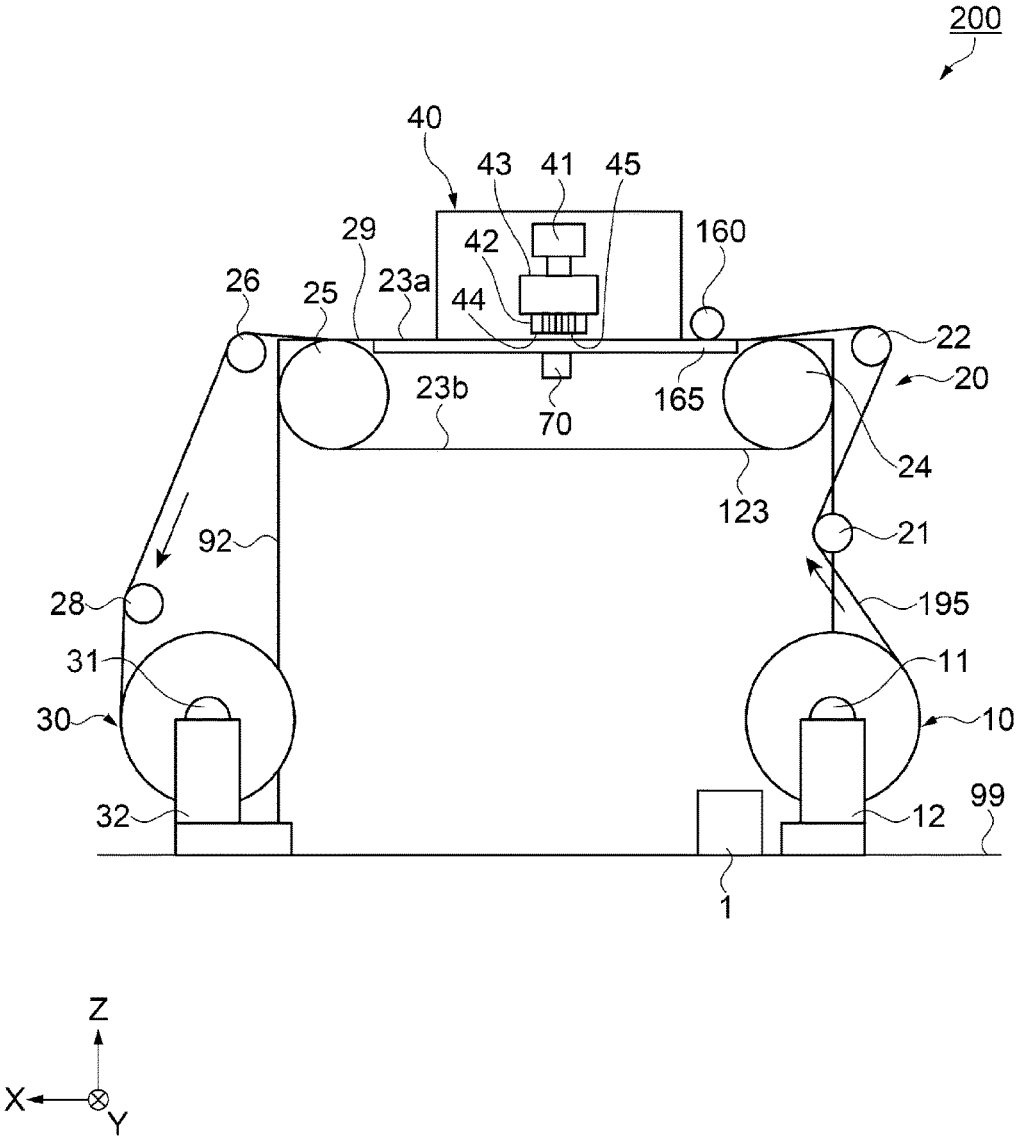
FIG. 8 is a schematic diagram illustrating a general overall configuration of a printing apparatus according to a modification.

FIG. 8 is a schematic diagram illustrating a general overall configuration of a printing apparatus according to a modification of the foregoing exemplary embodiments.

Although in Exemplary Embodiments 1 to 3 described above, the endless belt 23 is provided with the sticky layer 29 and a cloth is used as the recording medium 95, this arrangement does not limit the invention.

Hereinafter, a printing apparatus 200 according to a modification will be described. Note that substantially the same portions and the like as those in Exemplary Embodiment 1 are given the same reference numerals and redundant descriptions are omitted below.

An endless belt 123 has been formed to be endless by connecting two opposite ends of a band-shaped belt. The endless belt 123 has been wrapped around a belt turning roller 24 and a belt driving roller 25. The endless belt 123 is held with a predetermined tension acting so that portions of the endless belt 123 between the belt turning roller 24 and the belt driving roller 25 are parallel to a floor surface 99. The endless belt 123 is made of a flexible material.

A platen 165 that extends in a transport direction (X-axis direction) is provided at a position that faces a printing section 40 across the endless belt 123. The platen 165 contains electrodes (not graphically shown). At an upstream end of the platen 165 there is provided a nip roller 160 that presses a recording medium 195 against the endless belt 123 after the recording medium 195 has been transported from a transport roller 22 and superposed on the endless belt 123. When a voltage is applied to the electrodes contained in the platen 165, the recording medium 195 is electrostatically attached to the endless belt 123 and thereby transported in the transport direction. Therefore, the recording medium 195, such as paper, can be transported by the endless belt 123.

Application of any one of the printing operations illustrated above in conjunction with Exemplary Embodiments 1 to 3 to the printing apparatus 200 will achieve substantially the same advantageous effects as stated above.

This application claims priority under 35 U.S.C. §119 to Japanese Patent Application No. 2015-142717, filed Jul. 17, 2015. The entire disclosure of Japanese Patent Application No. 2015-142717 is hereby incorporated herein by reference.

What is claimed is:

1. A printing apparatus comprising:

a belt mover for an endless belt which carries out a line feed of a recording medium, the endless belt including a portion that causes the recording medium to adhere to the endless belt;

a feed amount calculator that calculates an amount of belt feed of the belt mover; and a movement amount measurer that measures actual amount of movement of the endless belt by image processing by taking an image of a surface of the endless belt, wherein:

the feed amount calculator calculates the amount of belt feed by which the endless belt is to be fed, on the basis of the amount of belt feed by which the endless belt has been fed and the actual amount of movement of the endless belt measured by the movement amount measurer; and the belt mover moves the endless belt by the amount of belt feed calculated.

2. The printing apparatus according to claim 1, wherein:

the belt mover carries out the line feed of the recording medium by a first movement in which the endless belt is moved by a first amount of feed and a second movement in which the endless belt is moved by a second amount of feed; and the second amount of feed contains a compensation amount of feed that compensates a difference between the first amount of feed by which the endless belt has been fed and the actual amount of movement by which the endless belt has been moved by the first movement and which has been measured by the movement amount measurer.

3. The printing apparatus according to claim 2, wherein:

the first amount of feed is a reference amount of movement for carrying out the line feed of the recording medium by a predetermined amount of line feed; and the second amount of feed is the compensation amount of feed.

4. The printing apparatus according to claim 2, wherein:

the first amount of feed is an amount of belt feed obtained by subtracting a predetermined value from a reference amount of movement for carrying out the line feed of the recording medium by a predetermined amount of line feed;

the second amount of feed is an amount of belt feed obtained by adding the predetermined value to the compensation amount of feed; and in the second movement, the endless belt is moved in the same direction as a moving direction in which the endless belt is moved in the first movement.

5. The printing apparatus according to claim 1, wherein the movement amount measurer takes an image of a surface of the endless belt by taking an image of a bottom surface of the endless belt at a first location and then taking an image of the bottom surface of the endless belt at a second location after the endless belt has been moved.

* * * * *